United States Patent [19]

Gerber

[11] 4,050,025

[45] Sept. 20, 1977

[54] APPARATUS FOR OBTAINING A MEAN VOLTAGE VALUE

[75] Inventor: Bernhard Gerber, Langenthal, Switzerland

[73] Assignee: Greiner Electronic AG

[21] Appl. No.: 709,240

[22] Filed: July 27, 1976

[30] Foreign Application Priority Data

Sept. 1, 1975 Switzerland ..... 11280/75

[51] Int. Cl.[2] ..... G06G 7/24

[52] U.S. Cl. ..... 328/143; 328/127; 324/189; 235/150.51; 235/183

[58] Field of Search ..... 328/127, 143, 144, 145, 328/151, 142; 324/189; 235/156, 183, 150.51, 193.5

[56] References Cited

U.S. PATENT DOCUMENTS

| | | | |
|---|---|---|---|
| 3,116,458 | 12/1963 | Margopoulos | 328/151 X |
| 3,488,482 | 1/1970 | Ley | 235/193.5 |
| 3,619,794 | 11/1971 | Richman | 328/144 X |
| 3,621,286 | 11/1971 | Varrasso | 328/127 X |
| 3,723,907 | 3/1973 | Tajchman et al. | 328/127 X |
| 3,809,874 | 5/1974 | Pozzetti et al. | 235/183 |
| 3,976,894 | 8/1976 | Perkins et al. | 328/127 X |

*Primary Examiner*—John S. Heyman
*Attorney, Agent, or Firm*—Lawrence E. Laubscher

[57] ABSTRACT

Apparatus comprising a measurement-transmitting unit with two outputs to generate a time sequence of voltage values containing a measured size to be averaged; a mean value-forming unit which has two inputs connected respectively to the two outputs of the measurement-transmitting unit, and a resistor-capacitor network for continuously averaging the voltage values fed to it by the measurement-transmitting unit, the resistor-capacitor network including a capacitor which is connected across the two inputs of the mean value-forming unit via at least one resistor and at least one controllable switch; and a program-control unit connected to said at least one controllable switch and having means to control said at least one controllable switch in such a way that, during at least some of the averaging processes, the capacitor is connected to the two inputs of the mean value-forming unit, via said at least one resistor, for a switching time $T_i$, which fulfills the condition $T_i = RC \ln (i/(i-1))$, where $i$ is the number of the voltage value, R is the resistance value of said at least one resistor effective when the i-th voltage value is supplied, and C is the capacitance of the capacitor. Preferably the apparatus includes two controllable switches, a second of which by-passes said at least one resistor, the program-control unit has means for closing said second of the switches to by-pass said at least one resistor when the first voltage value is supplied, and the program control unit is constructed so that it controls a first of the switches, in such a way that its switching time $T_i$ is successively shortened from the supplying of the second voltage value onwards, during a plurality of successive averaging processes.

3 Claims, 2 Drawing Figures

APPARATUS FOR OBTAINING A MEAN VOLTAGE VALUE

BRIEF DESCRIPTION OF THE PRIOR ART

The invention relates to apparatus comprising a measurement transmitting unit to generate a sequence of voltages, and a unit to form a mean value.

It has been proposed to average measured values, represented by a sequence of voltage values using an RC network. Apparatus for determining the average roughness of a surface is proposed in German specification No. 1930840 and has a first and a second capacitor, connected in series. A first electrode of the first capacitor is connected, via a resistor and a first switch, to the output of a pre-amplifier and to the input of an impedance transformer. The free electrode of the second capacitor is connected to earth. The second capacitor can additionally be by-passed by a second switch. The apparatus further comprises an indicating instrument, which on the one hand is connected to the output of the impedance transformer and on the other hand, by means of a third switch with five positions, can be connected to earth optionally via one of five resistors. When the apparatus is operated the total measuring time is divided into five equal periods. At the beginning of the first period the second switch is opened and the first switch closed. The third switch will be taken as being in the first of its five positions. The two capacitors are then charged to a first average measurement which is shown by the indicating instrument. At the end of the first period the second switch is closed so that the second capacitor is discharged. Before the beginning of the second period the second switch is re-opened. The first capacitor, already precharged, is charged further. At the end of the second period the second switch is again briefly closed. The process is continued in a similar way to the end of the fifth period. To enable the mean value always to be shown by the indicating instrument in periods 2 to 5, the sensitivity of the instrument is changed in stages by means of the third switch.

This previously proposed apparatus thus makes it possible for the measurements supplied during the five successive periods to be averaged. However, the mean value obtained does not correspond exactly to the arithmetical mean.

SUMMARY OF THE INVENTION

The present invention has among its objects apparatus which will enable a time sequence of voltage values each representing a measured size to be averaged, in such a way that exactly the arithmetical mean will be obtained.

The invention provides apparatus comprising a measurement-transmitting unit with two outputs to generate a time sequence of voltage values containing a measured size to be averaged; a mean value-forming unit which has two inputs connected respectively to the two outputs of the measurement-transmitting unit, and a resistor-capacitor network for continuously averaging the voltage values fed to it by the measurement-transmitting unit, the resistor-capacitor network including a capacitor which is connected across the two inputs of the mean value-forming unit via at least one resistor and at least one controllable switch; and a program-control unit connected to said at least one controllable switch and having means to control said at least one controllable switch in such a way that, during at least some of the averaging processes, the capacitor is connected to the two inputs of the mean value-forming unit, via said at least one resistor, for a switching time $T_i$, which fulfils the conditions $T_1 = RC \ln (i/(i-1))$, where $i$ is the number of the voltage value, R is the resistance value of said at least one resistor effective when the $i$-th voltage value is supplied, and C is the capacitance of the capacitor.

BRIEF DESCRIPTION OF THE DRAWING

The invention is diagrammatically illustrated by way of example in the accompanying drawing, in which.

DETAILED DESCRIPTION

Figure 1:
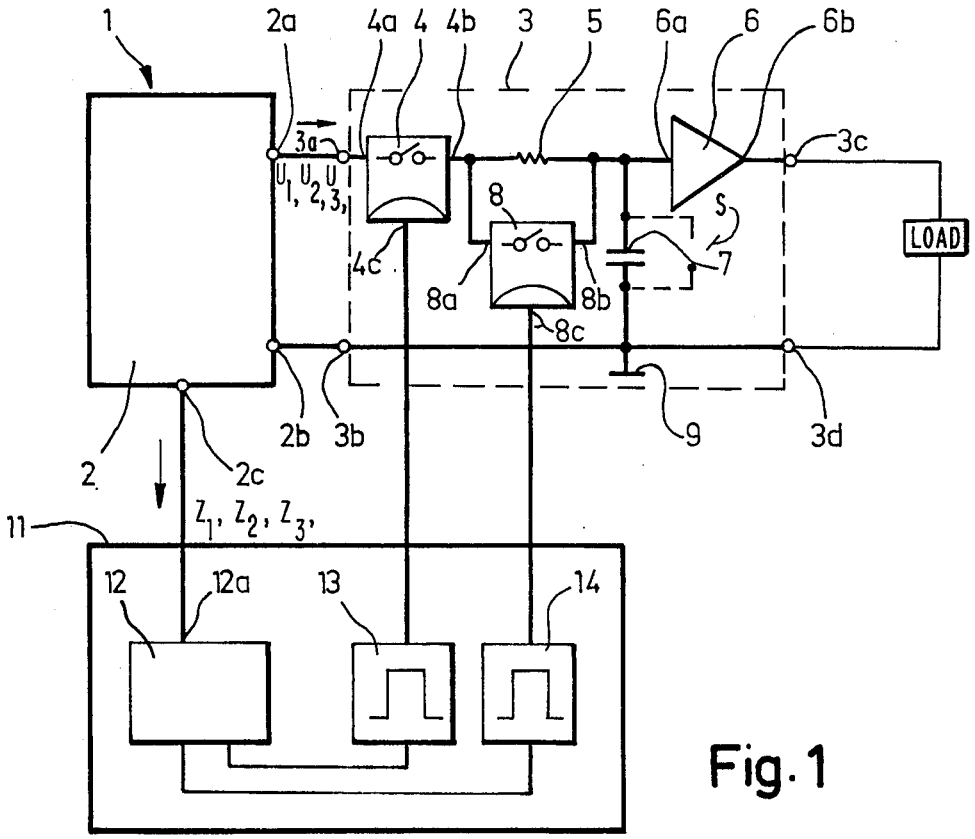
FIG. 1 is a circuit diagram of an apparatus according to the invention for averaging a measured size.

Referring to the drawing, apparatus 1 has a measurement-transmitting unit 2. This contains a measurement transmitter to convert sizes to be measured into electrical signals, or is provided with input terminals to connect such a measurement transmitter. The measurement-transmitting unit 2 is designed so that a series of voltage values appear at its outputs 2a, 2b, each of the voltage values containing an individual measurement of the measured size. The unit 2 has negligible output impedance and therefore represents an almost ideal voltage source. The unit 2 further contains means for feeding a counting pulse to an output 2c at each individual measurement.

The apparatus further comprises a unit 3 for forming a mean value. Inputs 3a, 3b of the unit 3 are connected to the outputs 2a and 2b respectively of the unit 2. The input 3a is connected to a line 4a of a controllable electronic switch 4. An output terminal 4b of the latter is connected via a resistor 5 to an input 6a of an impedance transformer 6 and to one electrode of a capacitor 7. The other electrode of capacitor 7 is connected to the input 3b, an output 3d of the mean value-forming unit 3 and to earth at 9. The line 4b of switch 4 is further connected to a line 8a of a further switch 8. An output terminal 8b of switch 8 is connected to the input 6a of the impedance transformer 6. An output 6b of the impedance transformer 6 is connected to an output 3c of the unit 3. The impedance transformer 6 has a high input and a low output resistance.

The apparatus further contains a program-control unit 11. This is provided with a counter unit 12 and two pulse transmitters 13 and 14. The counter unit 12 has an input 12a connected to the output 2c of the measurement-transmitting unit 2. The unit 11 counts the number of individual measurements with the aid of the incoming counting pulses, and controls the two pulse transmitters 13, 14. The outputs of the pulse transmitters 13 and 14 are connected to control terminals 4c and 8c of the controllable switches 4 and 8, respectively.

The operation of the apparatus will now be explained. The apparatus enables the mean to be formed from a plurality of individual measurements of a measured size. When a measurement is taken, the measurement-transmitting unit 2 delivers a sequence of individual voltage values $U_1$, $U_2$, $U_3$, . . . ., and signals the appearance of each voltage value to the program-control unit 11 by corresponding counting pulses $Z_1$, $Z_2$, $Z_3$ . . . . The capacitor 7 is discharged at the beginning of the measuring series by closing a by-pass switch S. During the first individual measurement the pulse transmitter 13 generates a first pulse after the arrival of the first counting pulse $Z_1$. Ths switch 4 is designed so that its switching section becomes conductive for the duration of the first pulse, that is to say, so that it establishes a conductive connection between the terminals 4a and 4b. The length of time for which the switching section of switch 4 is conductive will hereinafter be referred to as the switching time. The switching time will be taken as having a value $T_1$ when first voltage value $U_1$ is supplied. The pulse transmitter 14 generates a pulse simultaneously with the pulse transmitter 13. For the duration of this pulse the switching section of the switch 8 becomes conductive, so that the capacitor 7 is charged via the switches 4 and 8. The voltage over the capacitor 7 then becomes equal to the first voltage value $U_1$ generated by the measurement-transmitting unit 2.

When the unit 2 delivers the second voltage value $U_2$ a second counting pulse $Z_2$ is supplied to the program-control unit 11. At this and all successive counting pulses the pulse transmitter 14 is inoperative, so that the switch 8 remains open, i.e. in its non-conductive state. The pulse transmitter 13 on the other hand generates a second pulse as a result of counting pulse $Z_2$, and this pulse recloses the switch 4. The pulse transmitter 13 is designed so that the switching time $T_2$ is shorter than the switching time $T_1$. The capacitor 7, which is already charged to voltage $U_1$, is connected via the resistor 5 and the switch 4 to the output 2a of the measurement-transmitting unit 2. As a result of this, the voltage over the capacitor 7 changes somewhat depending on the size of the second voltage value $U_2$. Averaging thus takes place.

When the third voltage value $U_3$ is supplied the pulse transmitter 13 of the program-control unit 11 generates a third pulse, so that the switching time $T_3$ on supplying of the third voltage value $U_3$ is further shortened. At the fourth individual measurement switching time $T_4$ is further shortened relative to switching time $T_3$.

If the switching time is appropriately changed, the voltage over the capacitor 7 will correspond exactly to the arithmetical mean of the successive voltage values. This will now be explained.

$U_i$ will hereinafter refer to the $i$—th and $U_{i-1}$ to the $(i-1)$-th voltage value. $M_i$ will further be taken as referring to the arithmetical mean of voltage values $U_1$ to $U_i$ and $M_{i-1}$ will correspondingly be the mean of voltage values $U_1$ to $U_{i-1}$. The following equation then obtains:

$$M_i = M_{i-1} + (U_i - M_{i-1})/i \quad (1)$$

It will first be assumed that a capacitor of capacitance C is connected, via a resistor with resistance value R, to a DC voltage source which generates a DC voltage $U_i$ from the time $t=0$ onwards. The behaviour in time of voltage $U_c$ at the capacitor is then given by the equation:

$$U_c = U_i(1-e^{-t/RC}) \quad (2)$$

Release after the time $t$ gives the equation:

$$t = RC\ ln(U_i/(U_i - U_c)) \quad (3)$$

Figure 2:
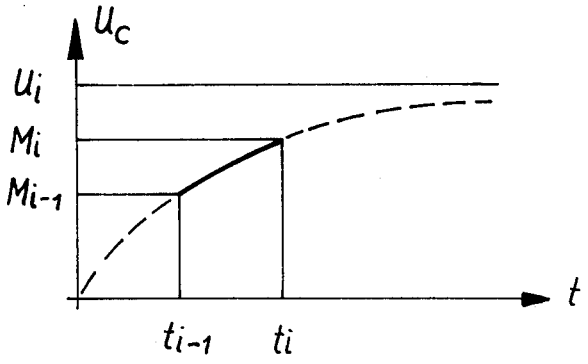
FIG. 2 is a time-voltage graph to explain the formation of the average value.

The voltage at the capacitor will now be assumed to have the value $M_{i-1}$ at the time $t_{i-1}$ and the value $M_i$ at the time $t_1$. This is illustrated in FIG. 2. The following formulae are then obtained from equation (3):

$$t_{i-1} = RC\ ln(U_i/(U_i - M_{i-1})) \quad (4)$$

and $$t_i = RC\ ln(U_i/(U_i - M_i)) \quad (5)$$

If $T_i$ represents the switching time at the $i$-th individual measurement, the switching time may additionally be required to fulfil the following condition:

$$T_i = t_i - t_{i-1} \quad (6)$$

If equations (4) and (5) are included in equation (6) and equation (1) is then included the following formula is obtained:

$$T_i = RC\ ln(i/(i-1)) \quad (7)$$

If the resistance value of the resistor 5 is used for R and the capacitance of the capacitor 7 for C and if $T_i$ is established according to equation (7), the voltage $U_c$ over the capacitor 7 will correspond exactly to the arithmetical mean of the successive voltage value $U_i$.

The following table shows the values of the ratio $T_i/RC$ for $i$ = 1 to 4.

| i | 1 | 2 | 3 | 4 |
|---|---|---|---|---|
| $T_i$/RC | ∞ | 0.69 | 0.41 | 0.29 |

If the time constant of the resistor-capacitor network is kept constant the switching time to obtain accurate arithmetical averaging should theoretically be infinitely long for $i-1$. In many practical applications, however, a $T_i$RC ratio of 10 to 20/1 should give sufficient accuracy. Since for reasons of time it is often not possible to obtain a high enough $T_i/RC$ ratio with an invariable time constant, the resistor 5 is by-passed for $i=1$, as described previously.

If required by the measuring task, the arithmetical mean may naturally be formed using not merely four but any number of voltage values. The switching time is changed so that the condition given by equation (7) is fulfilled at all individual measurements, and the voltage at the capacitor 7 at the end of the measuring series corresponds exactly to the arithmetical means of all the voltage values $U_i$.

However, measurement may be discontinued as soon as the mean value comes within a predetermined tolerance range. In other cases particularly when the mean value is recorded continuously, the switching time $T_i$ may be changed to fulfil equation (7) only e.g. up to the third or fourth individual measurement and mean value formation. For all subsequent individual values switching time $T_i$ is left constant. The measurements supplied are still averaged. But the voltage at the capacitor 7 no longer corresponds exactly to the arithmetical mean but rather to a weighted mean. If the switching time is kept constant, the last individual measurement in the mean value formation is given greater weight than perhaps the first or other preceding individual measurements.

The apparatus may obviously be modified in other respects. For example, the condition defined by equation (7) could be fulfilled not by changing the switching time but by providing a plurality of switches and, instead of the resistor 5, a network with a combination of a plurality of resistors. The resistors could then be switched over or connected in parallel by means of the switches, in such a way that the resistance value of the combination effective for the averaging process is increased in stages. The apparatus described can average any measured sizes which can be converted into a sequence of voltage values by means of a measurement transmitter. To enable an accurate arithmetical mean to be formed, however, the measured size at each individual measurement must be constant at least during the switching time. Some examples, apart from the roughness values mentioned at the beginning, are perhaps measurements from weighing, volume control, chemical analysis or oscillating parameters of clockwork oscillating systems, such as amplitude, length of period or travel or out of beat error.

What is claimed is:

1. Apparatus for obtaining the mean value of a number of measuring voltage values, comprising a. measuring-transmitting means (2) for producing a series of measurement voltages ($U_1$, $U_2$, $U_3$, . . . ) and a series of counting pulses ($Z_1$, $Z_2$, $Z_3$, . . . ) corresponding with said measurement voltages, respectively;

b. mean-value producing means (3) having at least one input terminal **(3*a*) connected with measuring-transmitting means for receiving said series of measurement voltages, and at least one output terminal (3*c*)** adapted for connection with load, said mean-value producing means including a series branch connected between said input and output terminals including, in series,

1. first switch means (4) operable between normally open and closed conditions, respectively; and

2. a resistor-capacitor network including a resistor (5) connected between said first switch means and said output terminal, and a capacitor (7) connected in parallel with the load; and c. program-control means (11) having an input terminal connected with said measuring-transmitting means for receiving said counting pulses, said program-control means being operable upon the receipt of said counting pulses to close said first switch means for selected periods of time $T_i$ which fulfill the condition $T_i = RCln(i/(i-1))$, where $i$ is the number of the voltage value, R is the resistance value of said resistor when the $i$-th voltage value is supplied, and C is the capacitance of said capacitor, whereby the output voltage at said output terminal is the average of the series of measurement input voltages.

2. Apparatus as defined in claim 1, and further including second switch means (8) connected in parallel across said resistor, said second switch means being operable between normally open and closed conditions, respectively, said program-control means being operable to close said second switch means only upon the occurrence of the first counting pulse;

and further wherein said program control means is operable to close said first switch means for successive switching time periods $T_i$ that are progressively shorter, respectively.

3. Apparatus as defined in claim 1, wherein the switching time $T_i$, the effective resistance of the resistor, and the capacitance of the capacitor remain constant after a predetermined number of averaging procedures.

* * * * *